US008332983B1

(12) United States Patent
Prohoroff

(10) Patent No.: US 8,332,983 B1
(45) Date of Patent: Dec. 18, 2012

(54) ROTARY BRUSH ASSEMBLY FOR STREET SWEEPER

(76) Inventor: Phillip W. Prohoroff, Goodyear, AZ (US)

( * ) Notice: Subject to any disclaimer, the term of this patent is extended or adjusted under 35 U.S.C. 154(b) by 585 days.

(21) Appl. No.: 12/587,765

(22) Filed: Oct. 13, 2009

(51) Int. Cl.
*A47L 11/00* (2006.01)
*A46B 13/02* (2006.01)

(52) U.S. Cl. ..... 15/87; 15/176.6; 15/180

(58) Field of Classification Search ..... 15/87, 180, 15/202, 176.1, 176.6
See application file for complete search history.

(56) References Cited

U.S. PATENT DOCUMENTS 5,421,053 A * 6/1995 Chodak ..... 15/87
7,690,071 B1 * 4/2010 Prohoroff ..... 15/180
7,992,245 B2 * 8/2011 Schuetz et al. ..... 15/52.1

* cited by examiner

*Primary Examiner* — Shay Karls
(74) *Attorney, Agent, or Firm* — H. Gordon Shields

(57) ABSTRACT

A rotating brush assembly for a street sweeper utilizes a hub to connect a hydraulic pump to a rotatable brush plate. A collar on the hub extends upwardly from a base flange and a tapered bore extends through the collar and the base flange and receives a mating tapered portion of a rotatable shaft of the pump. A downwardly extending rim on the bottom of the base flange locates the hub relative to a central aperture in the brush plate. The bottom of the base flange includes a recess which extends upwardly from the rim. The tapered bore communicates with the recess. The recess receives a threaded bottom portion of the rotatable shaft of the pump and a nut which is disposed on the threaded portion of the pump shaft.

10 Claims, 2 Drawing Sheets

ROTARY BRUSH ASSEMBLY FOR STREET SWEEPER

CROSS REFERENCE TO RELATED APPLICATIONS

Not applicable

STATEMENT REGARDING FEDERALLY SPONSORED RESEARCH OR DEVELOPMENT

Not Applicable

BACKGROUND OF THE INVENTION

1. Field of the Invention

This invention pertains to a rotary brush assembly for a street sweeper, and, more particularly, to a rotary brush assembly for a street sweeper having a hub for connecting a hydraulic pump to a sweeper brush plate.

2. Description of the Prior Art

In the prior art, collars for connecting hydraulic pumps to brush plates are welded directly to a brush plate. The welding itself may have deleterious effects on the plate due to the heat required to accomplish the welding. The heat may warp the brush plate. Moreover, the collar may not be centered on the brush plate when welded directly to the plate. Such offset, although not large, causes vibration and also warping of the plate.

Another problem with the welding is the removal of the hydraulic pump when the pump fails. In order to remove the pump, the plate must usually be removed and then the pump removed from the collar.

The weak link in a rotary brush assembly is the hydraulic pump. The pumps break down and must be replaced. In the prior art, due to the design and welding of the collars, the removal of the plates and the pumps requires a substantial amount of time and effort. The present invention greatly simplifies the removal and replacement procedure for the rotary brush assembly by providing a hub which bolts to the brush plate. The removal of the hub is relatively easily and speedily accomplished. The hydraulic pump is then removed and replaced and the hub may then be bolted to a brush plate.

SUMMARY

The invention described and claimed herein comprises a rotary brush assembly for a street sweeper and includes a hub for connecting a hydraulic motor to a street sweeper brush plate. The hub includes a flange and a collar with a tapered bore for receiving a tapered shaft of a hydraulic pump and a locating rim for centering the hub in a hub receiving aperture in the sweeper brush plate. The hydraulic pump is bolted to the hub, and the hub is bolted at its flange to the brush plate.

Among the objects of the present invention are the following:

To provide a new and useful rotary brush assembly for a street sweeper;

To provide a new and useful rotary brush assembly for a street sweeper including a sweeper brush plate, a hub, and a hydraulic pump combination;

To provide a new and useful combination of sweeper brush plate and a hub for connecting a hydraulic pump to the sweeper brush plate;

To provide a new and useful hub for connecting a hydraulic pump to a sweeper brush plate;

To provide a new and useful hub having bolt holes for connecting a hydraulic pump to a sweeper brush plate;

To provide a new and useful hub having a flange and a locating rim extending into a flange receiving aperture in a sweeper brush plate; and To provide a new and useful hub having a recess for receiving a bolt for securing a hydraulic pump shaft to the hub.

DETAILED DESCRIPTION OF THE INVENTION

Figure 1:
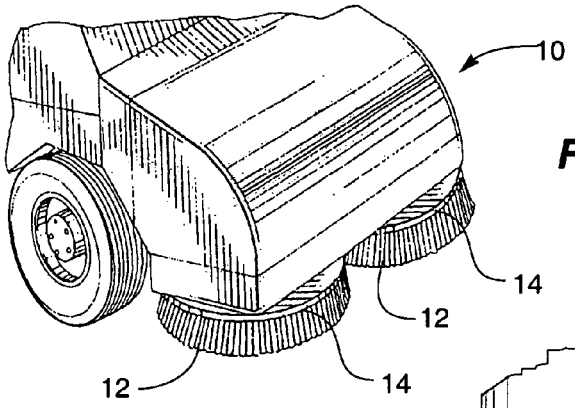
FIG. 1 is a perspective view of a portion of a street sweeper.
Figure 2:
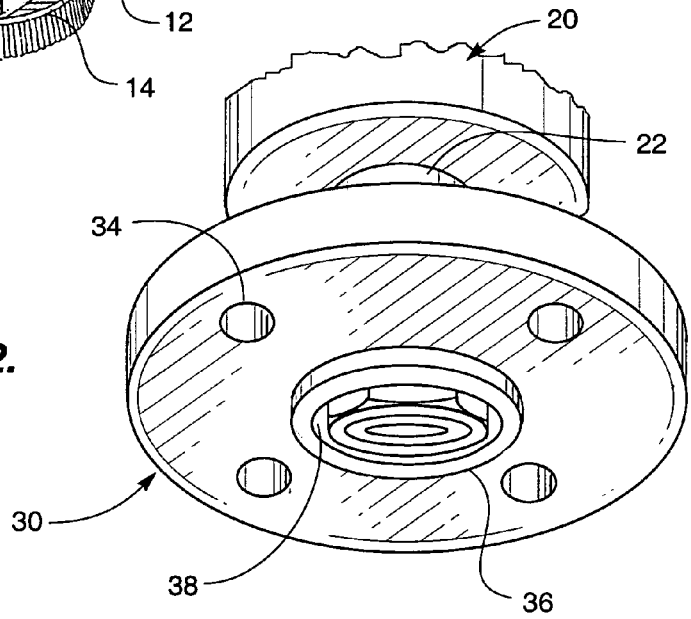
FIG. 2 is a bottom perspective view of a portion of a hub and a hydraulic pump.
Figure 3:
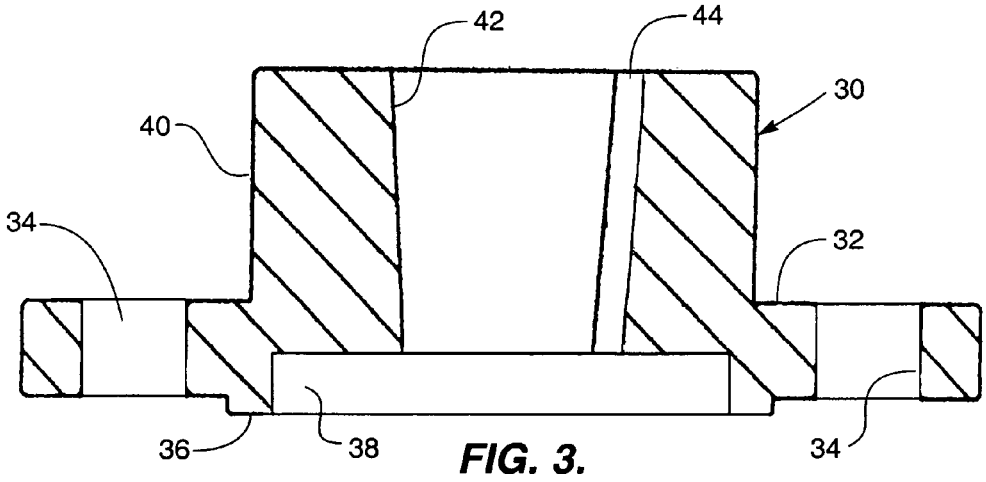
FIG. 3 is a sectional view of the hub of the present invention.
Figure 4:
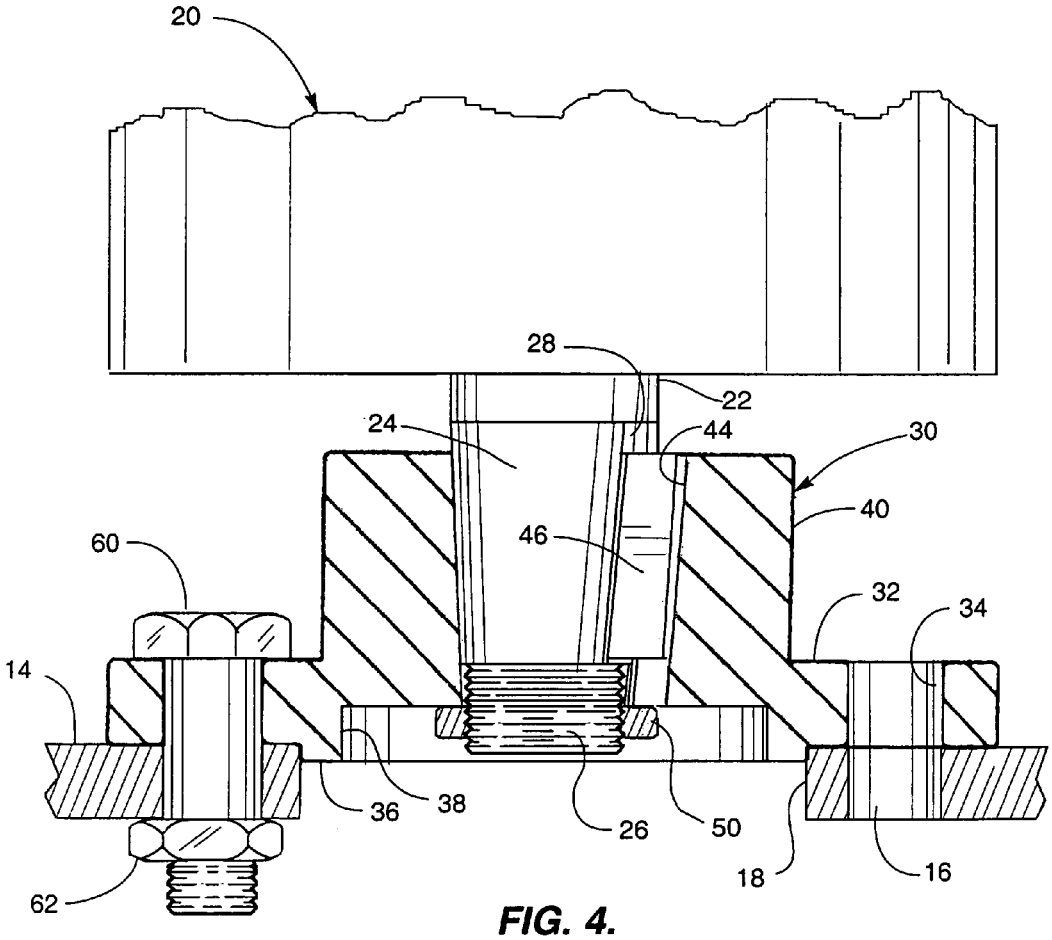
FIG. 4 is a view in partial section of a portion of a street sweeper plate, a connecting hub, and a hydraulic pump.

FIG. 1 is a perspective view of a portion of a street sweeper 10, showing two sets of brushes 12 secured to rotatable brush plates 14. The work environment of the present invention is the street sweeper 10 and its brush plates 14 and hydraulic pumps 20 (not shown in FIG. 1) and hubs 30 (also not shown in FIG. 1) which connect the hydraulic pumps to the brush plates to rotate the brush plates and their brushes. FIG. 2 is a bottom perspective view of a connecting hub 30 and a portion of a hydraulic pump 20. FIG. 3 is a sectional view of the hub 30 shown in FIG. 2. FIG. 4 is a view in partial section of a portion of a sweeper plate 14, the connecting hub 30, and a portion of the hydraulic pump 20. For the following discussion, reference may be made to all four of the drawing figures.

The brush plates 14 include a plurality of holes 16 which receive bolts for securing a hub 30 to the plates 14. Each plate 14 also includes a circular central aperture 18. The bolt holes 16 are appropriately spaced apart from each other about the central aperture 18.

Each plate 14 is rotated by a hydraulic pump 20. The pump 20 includes a rotatable shaft 22. The shaft 22 includes a tapered portion 24. At the lower end of the tapered portion 24 is a threaded portion 26. There is a keyway or key slot 28 on the tapered portion of the shaft 22 above the threads and below the upper cylindrical portion of the shaft 22. The keyway or key slot 28 is best shown in FIG. 4.

The pump 20 is connected to the rotatable brush plate 14 through the hub 30. The hub 30 includes a base flange 32 which is disposed on the plate 14. Extending through the base flange 32 are bolt holes 34. The bolt holes 34 align with the bolt holes 16 in the plate 14. Extending downwardly from the bottom of the flange 32 is a circular rim 36. The outer diameter of the rim 36 is very slightly less than the diameter of the central aperture 18 of the plate 14. The rim 36 extends into the mating portion of the plate 14, namely the aperture 18 to locate the hub 30 and its hydraulic pump 20 on the plate 14. Bolts, one of which is shown in FIG. 4, then extend through the aligned holes 16, 34 to secure the hub 30 and pump 20 to the plate 14.

The hub 30 also includes a circular bottom recess 38. The recess 38 extends upwardly from the circular rim 36 and into the flange 32.

Extending upwardly from the flange 32 is a cylindrical collar 40. Extending downwardly through the cylindrical collar 40 and communicating with the recess 38 is a tapered bore 42. The tapered bore 42 receives the tapered portion 28 of the pump's shaft 22.

A keyway or key slot 44 extends into the collar 40 from the slot 42. The slot 44 is aligned with the slot 28 in the shaft 22 and receives a key 46 to prevent relative rotation of the shaft 22 and the hub 30 and plate 14.

The threaded portion 26 of the rotatable shaft 22 is secured to the hub 30 and the plate 14 by a nut 50. The nut 50 and the threaded lower portion of the shaft 22 are disposed within the recess 38. Thus, the hydraulic pump 20, the hub 30, and the plate 14, with its brushes 12, are secured together. When the pump 20 is actuated, the plate 14 and its brushes 12 then rotate in response to rotation of the rotatable shaft 22 to accomplish the sweeping purpose of the street sweeper 10.

A bolt 60 and a nut 62 are shown in FIG. 4 illustratively securing the hub 30 and the brush plate 14 together.

While the principles of the above described apparatus have been made clear in illustrative embodiments, without departing from those principles there may occur to those skilled in the art modifications of structure, arrangement, proportions, the elements, materials, and components used in the practice of the apparatus, and otherwise, which are particularly adapted to specific environments and operative requirements. The appended claims are intended to cover and embrace any and all such modifications within the limits only of the true spirit and scope of the'present disclosure.

What I claim is:

1. A rotary brush assembly for a street sweeper comprising in combination:

a rotatable brush plate;

a circular central aperture in the rotatable brush plate;

a hub for receiving a hydraulic pump, including a base flange, a circular bottom rim extending downwardly from the base flange and into the circular central aperture for locating the hub relative to the rotatable brush plate, a circular recess on the base flange extending upwardly from the circular bottom rim, a collar extending upwardly from the base flange, and a bore extending through the collar and the base flange and communicating with the recess;

a hydraulic pump for rotating the rotatable brush plate;

a rotatable shaft extending from the hydraulic pump; and means for securing the hydraulic pump to the hub for rotating the rotatable brush plate in response to rotation of the rotatable shaft.

2. The rotating brush assembly of claim 1 in which the means for securing the hydraulic pump to the hub includes a threaded portion on the rotatable shaft and a nut secured to the threaded portion and disposed in the recess on the base flange.

3. The rotating brush assembly of claim 2 in which the rotatable shaft of the hydraulic pump includes a tapered portion adjacent to the threaded portion, and the bore in the collar of the hub includes a mating tapered portion for receiving the tapered portion of the rotatable shaft.

4. The rotating brush assembly of claim 1 in which the means for securing the hydraulic pump to the hub includes a first key slot on the rotatable shaft, a second key slot in the bore of the hub aligned with the key slot on the rotatable shaft, and a key disposed in the aligned first and second key slots.

5. The rotating brush assembly of claim 1 which further includes means for securing the hub to the rotatable brush plate.

6. The rotating brush assembly of claim 5 in which the means for securing the hub to the rotatable brush plate includes a plurality of bolt holes extending through the base flange outwardly from the collar.

7. The rotating brush assembly of claim 6 which further includes a plurality of bolt holes extending through the rotatable brush plate outwardly from the central aperture and aligned with the bolt holes in the base flange for receiving a plurality of bolts to secure the hub to the rotatable brush plate.

8. A hub for a securing a hydraulic pump to a rotatable brush plate comprising in combination:

a base flange to be disposed on the rotatable brush plate;

a bottom rim extending downwardly from the base flange and generally centered on the base flange for receiving a mating portion of the brush plate;

a recess extending upwardly into the base flange and generally centered on the base flange from within the bottom rim;

a collar extending upwardly from the base flange; and a bore extending through the collar and the base flange and communicating with the recess for receiving a mating portion of the hydraulic pump.

9. The apparatus of claim 8 which further includes a plurality of bolt holes disposed about the collar on the base flange.

10. The apparatus of claim 9 in which the bore is inwardly tapering through the collar and through the base flange.

* * * * *